US008584416B2

(12) United States Patent
Chenier et al.

(10) Patent No.: US 8,584,416 B2
(45) Date of Patent: Nov. 19, 2013

(54) MOVEMENT CONTROL SCREED

(75) Inventors: Gary Chenier, Winter Haven, FL (US); Michael Southern, Birmingham, AL (US)

(73) Assignee: Alabama Metal Industries Corporation

( * ) Notice: Subject to any disclaimer, the term of this patent is extended or adjusted under 35 U.S.C. 154(b) by 1956 days.

(21) Appl. No.: 11/293,023

(22) Filed: Dec. 2, 2005

(65) Prior Publication Data

US 2007/0130861 A1 Jun. 14, 2007

(51) Int. Cl.

| | |
|---|---|
| ***E04B 1/62*** | (2006.01) |
| ***E04B 1/68*** | (2006.01) |
| ***E04B 1/343*** | (2006.01) |
| ***E04F 15/14*** | (2006.01) |

(52) U.S. Cl.

USPC ..... 52/393; 52/396.04; 52/573.1

(58) Field of Classification Search

USPC ..... 52/573.1, 396.09, 396.08, 396.04, 395, 52/393, 345, 346, 351, 357, 358, 100, 52/287.1

See application file for complete search history.

(56) References Cited

U.S. PATENT DOCUMENTS

| | | | | |
|---|---|---|---|---|
| 1,029,106 | A | 6/1912 | Collins | |
| 1,204,955 | A | 11/1916 | Day | |
| 1,337,840 | A | 4/1920 | Hawley | |
| 1,389,057 | A | 8/1921 | Lavigue | |
| 1,555,392 | A * | 9/1925 | Tracy et al. | 52/273 |
| 1,624,121 | A | 4/1927 | Thiem | |
| 1,673,971 | A | 6/1928 | Dowell | |
| 1,954,847 | A * | 4/1934 | Scholer et al. | 52/371 |
| 2,114,048 | A | 4/1938 | Davis | |
| 2,142,305 | A | 1/1939 | Davis | |
| 2,272,162 | A | 2/1942 | Lackey | |
| 2,298,251 | A * | 10/1942 | Burson | 52/27 |
| 2,642,632 | A | 6/1953 | Savage | |
| RE24,658 | E | 6/1959 | Hollister | |
| 2,922,385 | A | 1/1960 | Murray | |
| 3,114,219 | A | 12/1963 | Bradley | |
| 3,139,703 | A | 7/1964 | Hilt | |
| 3,192,577 | A | 7/1965 | Barr | |
| 3,255,561 | A | 6/1966 | Cable | |
| 3,331,176 | A | 7/1967 | Washam | |
| 3,358,402 | A | 12/1967 | Sahm | |

(Continued)

FOREIGN PATENT DOCUMENTS

JP 2002364087 A 12/2002

OTHER PUBLICATIONS

*Stucco & Plaster Accessories*, Vinyl Corporation, available at http://www.vinylcorp.com/products/stuccoplast08.asp (Nov. 5, 2005), 2 pages.

(Continued)

*Primary Examiner* — Ryan Kwiecinski
(74) *Attorney, Agent, or Firm* — Jennifer Meredith, Esq.; Lippes, Mathias, Wexler, Friedman, LLP

(57) ABSTRACT

Various embodiments of the present invention are directed to a movement control screed that is structured for installation between first and second masonry coatings applied adjacent to a building wall. The movement control screed is structured as a control joint for absorbing movement between the first and second masonry coatings and also as a weep screed for accommodating drainage of water from behind the masonry coatings. The movement control screed comprises first and second flanges provided on opposite sides of first and second ribs.

4 Claims, 5 Drawing Sheets

(56) References Cited

U.S. PATENT DOCUMENTS

| | | | | | |
|---|---|---|---|---|---|
| 3,398,494 | A | | 8/1968 | Larson | |
| 3,411,260 | A | | 11/1968 | Dill | |
| 3,440,934 | A | | 4/1969 | Dill | |
| 3,568,391 | A | * | 3/1971 | Conway | 52/586.2 |
| 3,667,174 | A | | 6/1972 | Arnett | |
| 3,672,108 | A | * | 6/1972 | Conway | 52/367 |
| 3,951,562 | A | | 4/1976 | Fyfe | |
| 3,956,557 | A | | 5/1976 | Hurst | |
| 3,964,220 | A | | 6/1976 | Rutkowski et al. | |
| 4,302,262 | A | | 11/1981 | Kay | |
| 4,353,192 | A | | 10/1982 | Pearson et al. | |
| 4,364,212 | A | | 12/1982 | Pearson et al. | |
| 4,391,074 | A | | 7/1983 | Holsman | |
| 4,447,172 | A | | 5/1984 | Galbreath | |
| 4,485,600 | A | | 12/1984 | Olson | |
| 4,651,488 | A | * | 3/1987 | Nicholas et al. | 52/396.02 |
| 4,785,601 | A | | 11/1988 | Tupman | |
| 4,932,183 | A | | 6/1990 | Coulston | |
| 4,967,519 | A | | 11/1990 | Sieber | |
| 5,016,095 | A | | 5/1991 | Kii | |
| 5,079,880 | A | | 1/1992 | Reid | |
| 5,081,814 | A | | 1/1992 | Singletary et al. | |
| 5,248,225 | A | | 9/1993 | Rose | |
| 5,313,755 | A | | 5/1994 | Koenig, Jr. | |
| 5,338,130 | A | | 8/1994 | Baerveldt | |
| 5,349,797 | A | | 9/1994 | Stultz | |
| 5,365,713 | A | | 11/1994 | Nicholas et al. | |
| 5,375,386 | A | | 12/1994 | Goad | |
| 5,423,154 | A | | 6/1995 | Maylon et al. | |
| 5,477,643 | A | * | 12/1995 | Koenig, Jr. | 52/100 |
| 5,579,623 | A | * | 12/1996 | Stark et al. | 52/665 |
| 5,584,152 | A | | 12/1996 | Baerveldt | |
| 5,625,152 | A | | 4/1997 | Pandorf et al. | |
| 5,625,986 | A | | 5/1997 | Mansfield et al. | |
| 5,628,857 | A | | 5/1997 | Baerveldt | |
| 5,630,297 | A | | 5/1997 | Rutherford | |
| 5,791,111 | A | | 8/1998 | Beenders | |
| 5,799,456 | A | | 9/1998 | Shreiner et al. | |
| 5,802,785 | A | | 9/1998 | Crook | |
| 5,887,400 | A | | 3/1999 | Bratek et al. | |
| 5,916,095 | A | | 6/1999 | Tamlyn | |
| 5,937,600 | A | | 8/1999 | Larson | |
| 5,946,870 | A | | 9/1999 | Bifano et al. | |
| 5,970,671 | A | | 10/1999 | Bifano et al. | |
| 5,979,123 | A | | 11/1999 | Brockman | |
| 6,119,416 | A | | 9/2000 | Larson | |
| 6,119,429 | A | | 9/2000 | Bifano et al. | |
| 6,134,847 | A | | 10/2000 | Bifano et al. | |
| 6,161,344 | A | | 12/2000 | Blanchett | |
| 6,170,207 | B1 | | 1/2001 | Saindon | |
| 6,293,064 | B1 | | 9/2001 | Larson | |
| 6,298,609 | B1 | | 10/2001 | Bifano et al. | |
| 6,298,621 | B1 | * | 10/2001 | Lee | 52/302.6 |
| 6,305,130 | B1 | | 10/2001 | Ackerman, Jr. | |
| 6,385,932 | B1 | | 5/2002 | Melchiori | |
| 6,470,638 | B1 | | 10/2002 | Larson | |
| 6,491,468 | B1 | * | 12/2002 | Hagen | 403/291 |
| D471,991 | S | * | 3/2003 | Maylon et al. | D25/119 |
| 6,591,559 | B2 | * | 7/2003 | Contreras et al. | 52/101 |
| 6,609,341 | B2 | | 8/2003 | Maylon et al. | |
| 6,622,432 | B2 | | 9/2003 | Zacher et al. | |
| 6,640,508 | B2 | | 11/2003 | Lindgren et al. | |
| 6,698,144 | B1 | | 3/2004 | Larson | |
| 6,751,919 | B2 | * | 6/2004 | Calixto | 52/573.1 |
| 6,776,423 | B1 | | 8/2004 | Guht | |
| 6,893,187 | B2 | * | 5/2005 | Lehto et al. | 404/47 |
| 6,948,287 | B2 | | 9/2005 | Korn | |
| 6,948,716 | B2 | | 9/2005 | Drouin | |
| 7,240,905 | B1 | | 7/2007 | Stahl, Sr. | |
| 7,284,357 | B2 | * | 10/2007 | McInerney et al. | 52/741.41 |
| 2003/0177725 | A1 | | 9/2003 | Gatherum | |
| 2005/0257461 | A1 | | 11/2005 | Daly, IV | |
| 2006/0150553 | A1 | * | 7/2006 | Reyes et al. | 52/393 |
| 2007/0062137 | A1 | * | 3/2007 | Maylon | 52/367 |
| 2008/0016808 | A1 | | 1/2008 | Pilz | |

OTHER PUBLICATIONS

*Stucco & Plaster Accessories*, Vinyl Corporation, available at http://www.vinylcorp.com/products/stuccoplast02-2.asp (Nov. 5, 2005), 2 pages.

*Stucco & Plaster Accessories*, Vinyl Corporation, available at http://www.vinylcorp.com/products/stuccoplast02.asp (Nov. 5, 2005), 2 pages.

*Stucco & Plaster Accessories*, Vinyl Corporation, available at http://www.vinylcorp.com/products/stuccoplast08-2.asp, (Nov. 5, 2005), 2 pages.

*Metal Lath & Plaster*, G. Maylon, All-Wall Equipment, available at http://www.wconline.com/CDS/ArticleInformation/features/BNP_Features_Item/0.32 . . . (Oct. 21, 2005), 5 pages.

*Double "V" Expansion Control Joint*, Niles Building Products Company, available at http://www.nilesbldg.com/expansion.html (Oct. 21, 2005, 3 pages.

*Metal Lath > Expansion / Control Joint*, AMICO Metal Lath and Vinyl Bead Building Products, available at http://amico-lath.com/lath/expansion_control_joint.htm (Oct. 21, 2005), 3 pages.

*Floor Line Control Bead With Drip Edge*, Plastic PC Components Inc., Product Information, 1 page.

* cited by examiner

MOVEMENT CONTROL SCREED

BACKGROUND OF THE INVENTION

1. Field of the Invention

The present invention relates to building construction devices that provide drainage and reduce cracks within masonry coatings such as stucco. More specifically, the present invention relates to an improved movement control screed that is structured to operate as a control joint for absorbing movement in a masonry coating and also as a weep screed to provide drainage of water from within and behind the masonry coating.

2. Description of Related Art

Expansion control joints and foundation weep screeds are commonly known in the masonry construction arts. FIG. 1 depicts an exemplary expansion control joint 20 in accordance with the known prior art. Expansion control joints are used to break up large areas intended for receiving masonry coatings such as plaster, stucco, and the like, into smaller masonry coated areas for purposes of relieving stress and resisting cracking. The depicted expansion control joint 20 includes metal lath first and second flanges 25, 30, and metallic first and second ribs 30, 32 defined between the first and second flanges 25, 30. The metal lath flanges 25, 30 are typically attached to an exterior wall surface (not shown). First and second masonry coatings 42, 44 are applied to the exterior wall surface using the first and second ribs 30, 32 of the expansion control joint 20 as a guide for the applied thickness of the coatings. The first and second ribs 30, 32 of the expansion control joint 20 are symmetrical and deflectable for absorbing movement between the first and second masonry coatings 42, 44 during curing or other thermally induced expansion and contraction.

FIG. 2 depicts a foundation weep screed 70 structured in accordance with the known prior art. The foundation weep screed 70 is attached to an exterior wall 54 that is comprised of plywood sheathing 56 and attached to a wall frame 55 just above a concrete building foundation 60. Foundation weep screeds 70 are commonly produced from sheet metal and positioned at the base of the exterior wall 54 for supporting a masonry coating (not shown) and providing a barrier that prevents water from coming into contact with the exterior wall 54.

The depicted foundation weep screed 70 is secured to the base of the plywood sheathing 56. The foundation weep screed 70 includes a flange 72, and a rib 75. The rib 75 defines an extending portion 74 for supporting an applied masonry coating and a returning portion 76. The extending portion of the rib 75 begins generally adjacent the foundation transition 61 and tapers downwardly as shown. A drip edge DE is defined between the extending and returning portions 74, 76 of the rib 75. Water resistant building paper 62 is typically positioned over the exterior wall 54 and the flange 72 for directing moisture from behind the masonry coating and over the foundation weep screed 70. Moisture can get behind the masonry coating at improperly sealed joints (e.g., at doors or windows) or because of cracks that may form in the masonry coating. If left unchecked, such moisture may cause rotting of wooden structures within the wall. Installation of foundation weep screeds 70 as described above create a moisture path extending down the building paper 62, along the flange 72, and over the extending portion 74 of the rib 75 to the drip edge DE as shown.

In the wake of severe storms such as hurricanes, many jurisdictions have modified their building codes to require significant reinforcement of first level exterior walls. Typically, this reinforcement is provided by constructing first level exterior walls from reinforced concrete or other similar materials. Such walls provide enhanced wind and impact resistance. However, building codes continue to allow upper floors and roof structures to be made from wood trusses that rest on top of the concrete reinforced exterior walls. In this regard, wall transitions are now defined between dissimilar wall materials (e.g., wood and concrete) used for upper and lower floors. Accordingly, it would be desirable to prevent moisture from entering such wall transitions. It would also be desirable to support masonry coatings applied above and below the wall transitions and to absorb movement of the masonry coatings such as might occur during curing or thermal expansion and contraction of the coatings.

BRIEF SUMMARY OF THE INVENTION

The above needs and other advantages are met by a movement control screed that is structured for installation between first and second masonry coatings applied adjacent to a building wall and that functions both as an expansion control joint and as a weep screed. The movement control screed comprises first and second flanges and, in one embodiment, the first flange defines a planar substantially non-perforated surface for providing a moisture barrier and the second flange defines a substantially perforated surface that is adapted to more readily receive and support an applied masonry coating. At least two ribs defined between the flanges provide the ability for the flanges to move relative to each other and thus accommodate expansion, contraction, or other slight movements between adjoining wall sections. In addition, the ribs provide at least one drip edge to accommodate moisture drainage from behind a masonry coating and therefore the movement control screed also functions as a weep screed.

More specifically, a first rib defines a screed surface extending from the first flange adapted for positioning adjacent at least a portion of a first masonry coating and a second rib defines a screed surface extending from the second flange adapted for positioning adjacent at least a portion of a second masonry coating. In one embodiment, the first flange is deflectable from the second flange for supporting the first and second masonry coatings during relative movement. The screed surface of the first rib may also be deflectable relative to the screed surface of the second rib. Additionally, the screed surface of the first rib may be deflectable relative to the first flange and the screed surface of the second rib may be deflectable relative to the second flange. The above deflection capabilities operate to reduce cracking of the masonry coatings as will be apparent to one of ordinary skill in the art in view of the foregoing disclosure.

In another embodiment of the present invention, the first rib of the movement control screed defines a first screed depth that corresponds to a first masonry coating thickness and the second rib of the movement control screed defines a second screed depth that differs from the first screed depth and corresponds to a second masonry coating thickness. In one embodiment, the first screed depth is larger than the second screed depth. In this regard, first and second masonry coatings having differing thicknesses may be applied on either side of the movement control screed.

Another embodiment of the present invention is directed to a method of installing a movement control screed adjacent a building wall between first and second masonry coatings. The method includes attaching a movement control screed to the building wall wherein the movement control screed comprises a first flange, a second flange, a first rib defining a first screed depth disposed between the first and second flanges, and a second rib defining a second screed depth disposed between the first and second flanges. In one embodiment, the first screed depth is greater than the second screed depth. The method further includes a step of applying a first masonry coating to the building wall at a first masonry coating thickness that substantially corresponds to the first screed depth and applying a second masonry coating to the building wall at a second masonry coating thickness that substantially corresponds to the second screed depth.

The method may also include applying a water resistant layer over the first flange, before the step of applying the first masonry coating, in order to create a moisture path extending from the water resistant layer to the first flange and over the first rib. In addition, the method may include attaching a movement control screed having a first flange that is substantially non-perforated to encourage moisture to flow over and not behind the first flange. In yet another embodiment, the method may include attaching a movement control screed having a second flange that is substantially perforated to more readily receive and support the applied second masonry coating.

BRIEF DESCRIPTION OF THE DRAWINGS

Figure 1:
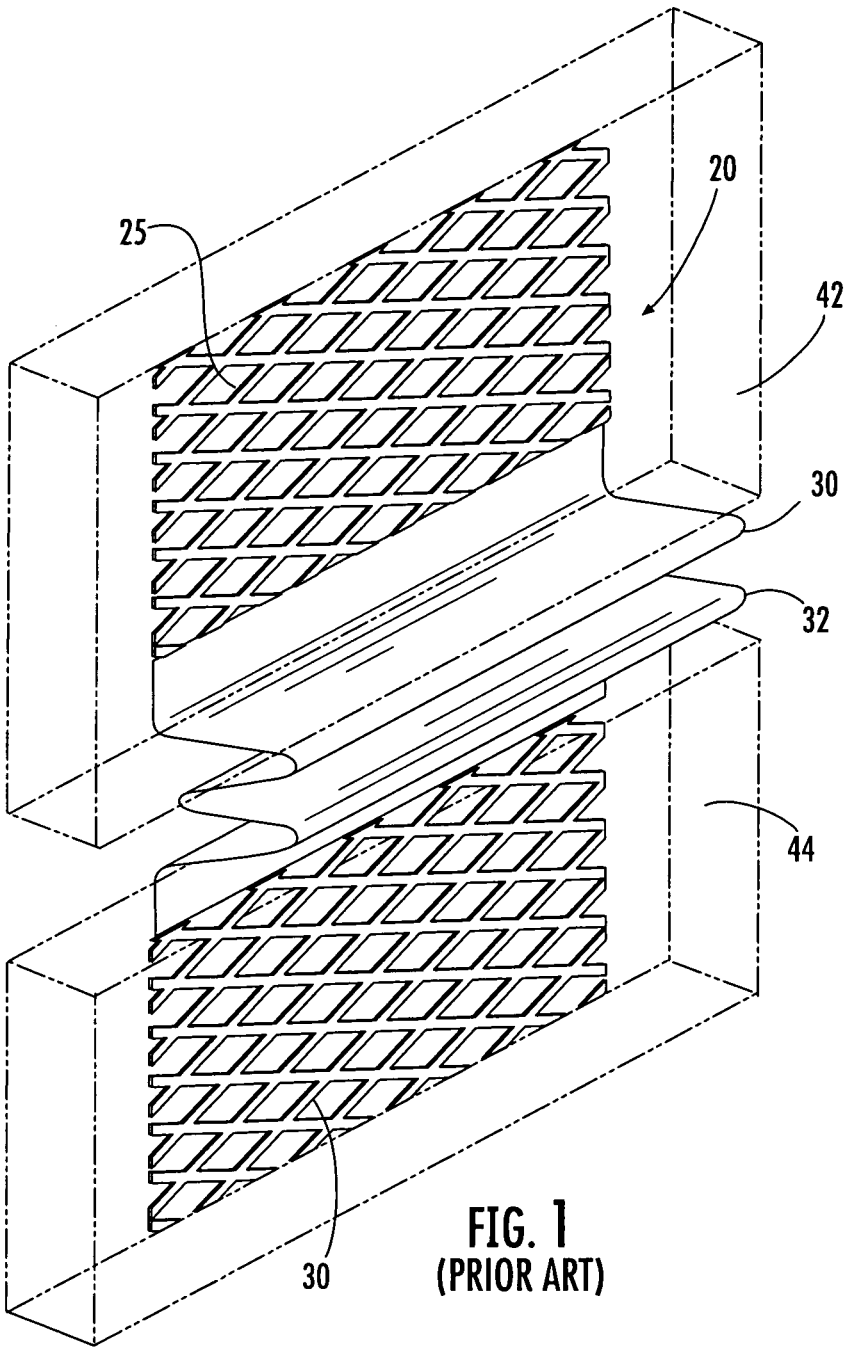
FIG. 1 (PRIOR ART)
Figure 2:
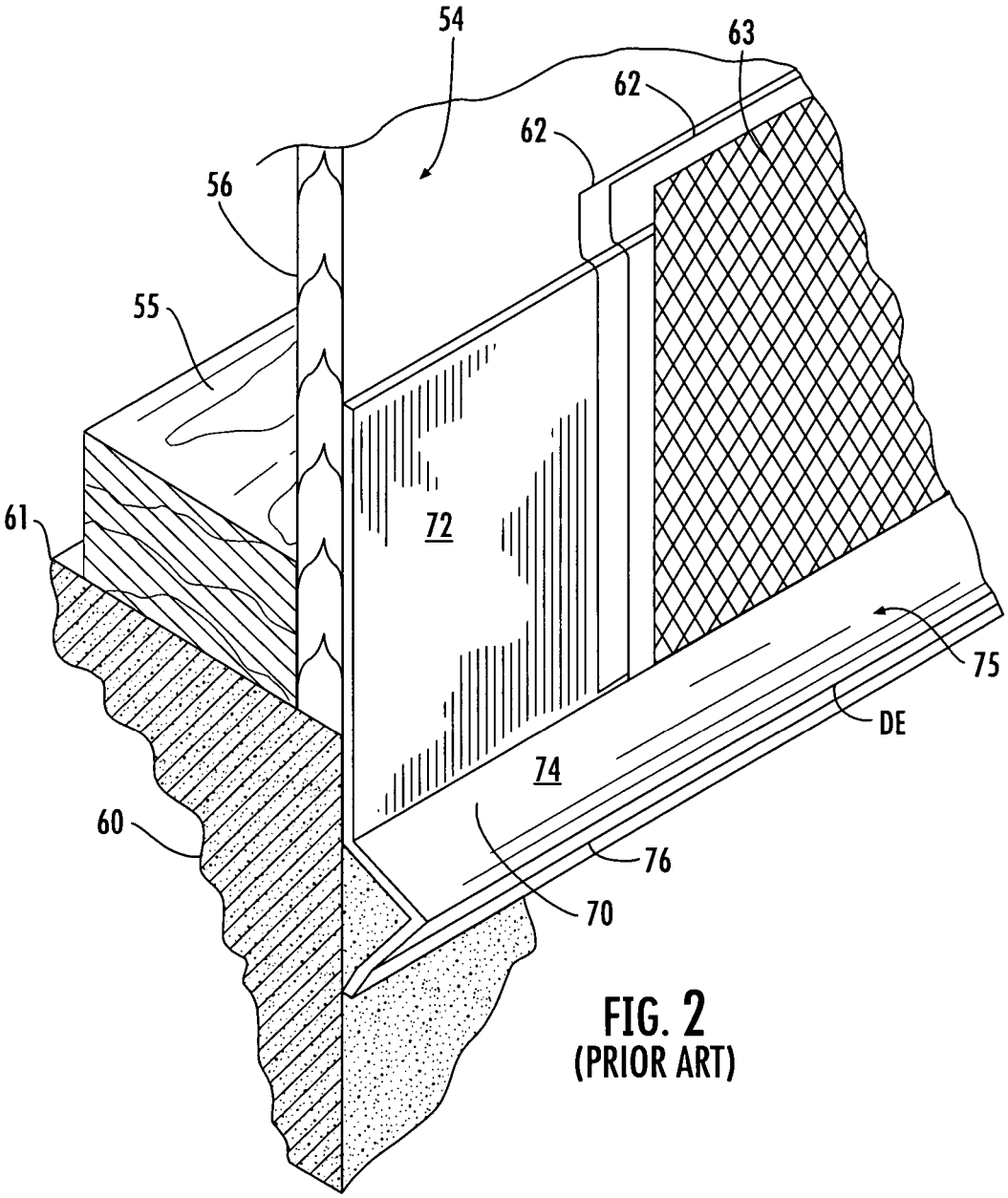
FIG. 2 (PRIOR ART)
Figure 3:
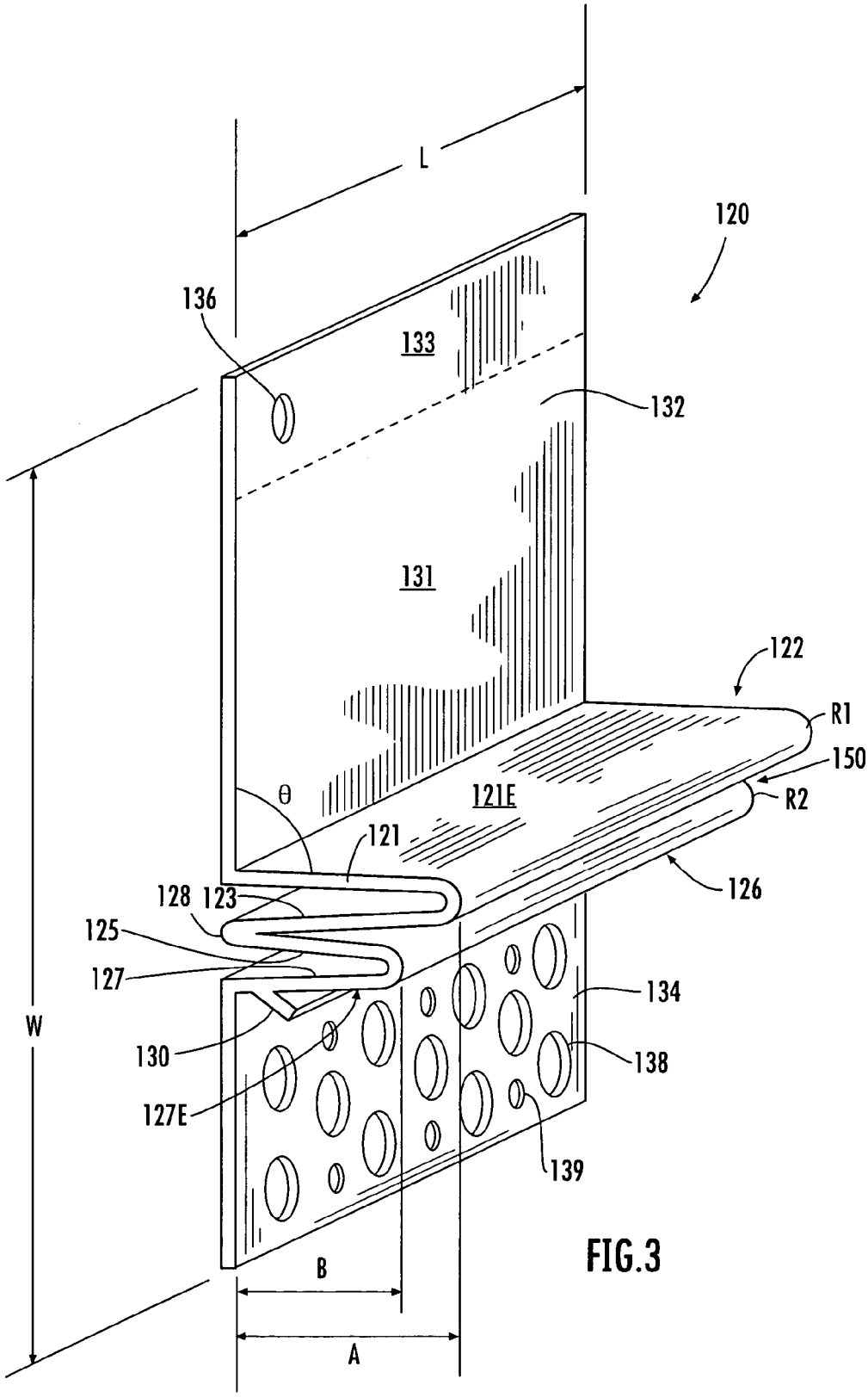
Figure 4:
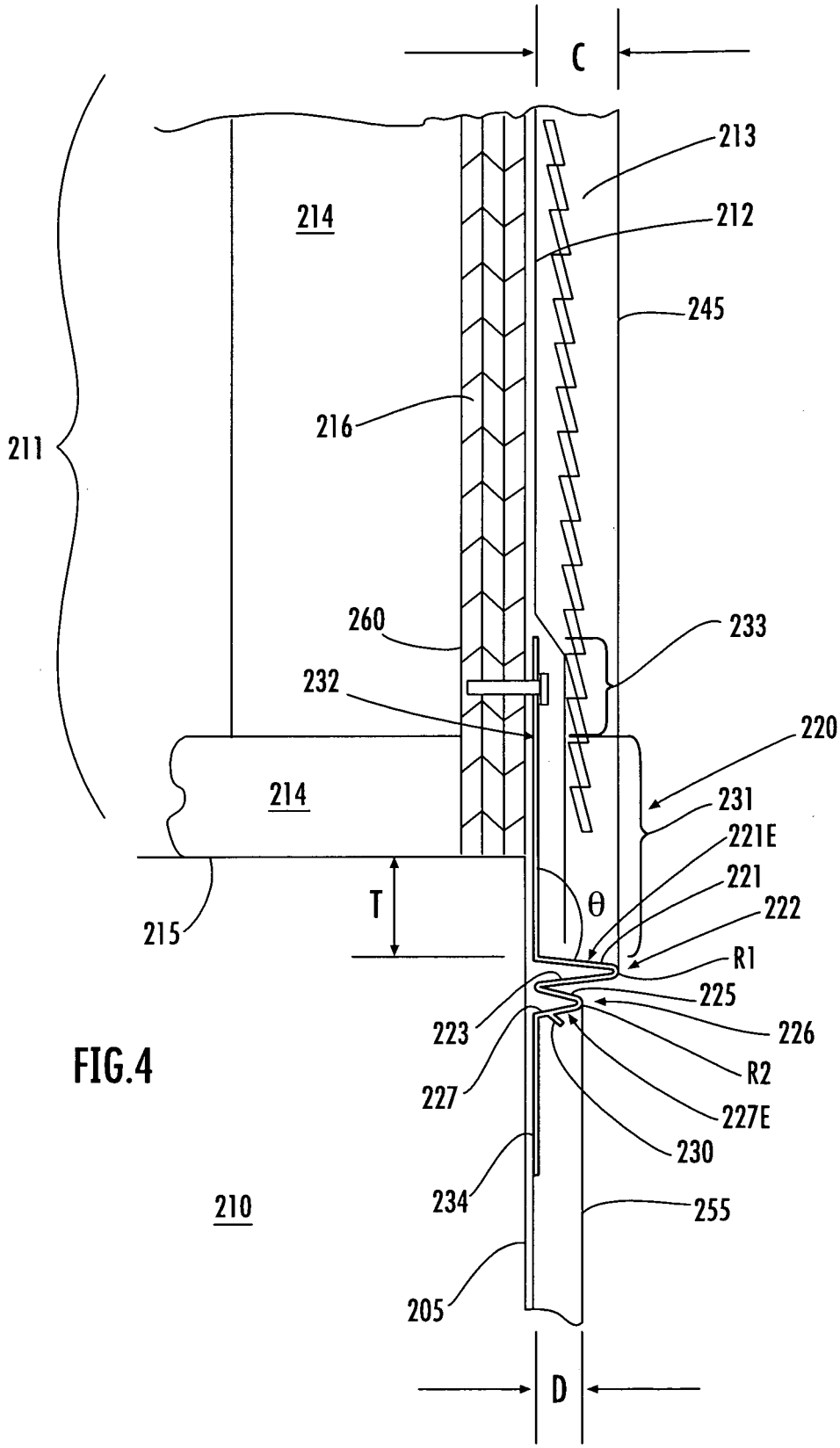
Figure 5:
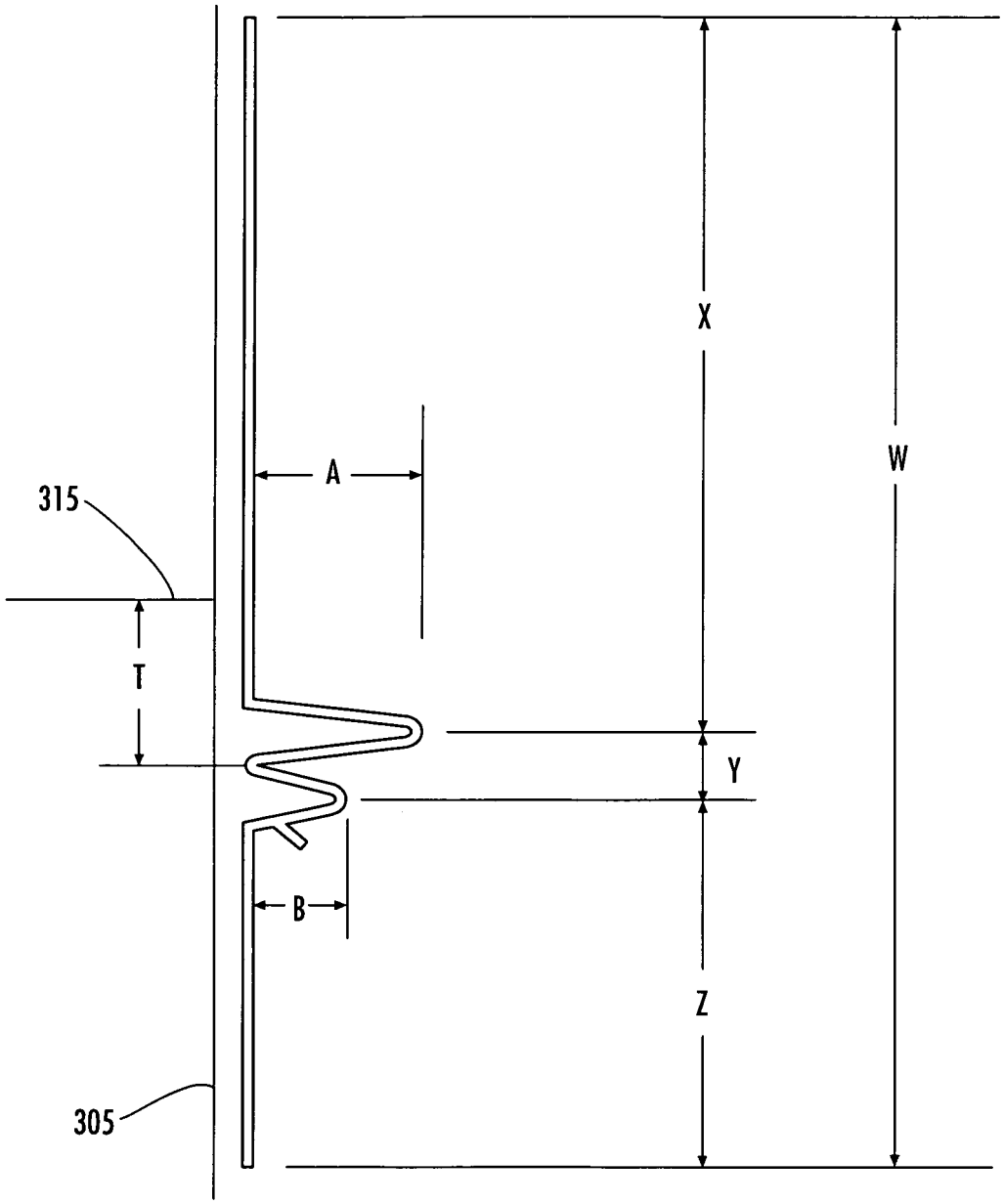

Having thus described the invention in general terms, reference will now be made to the accompanying drawings, which are not necessarily drawn to scale, and wherein:

FIG. 1 is a perspective view of an expansion control joint in accordance with the known prior art;

FIG. 2 is a perspective view of a foundation weep screed in accordance with the known prior art;

FIG. 3 is a perspective view of a movement control screed in accordance with one embodiment of the present invention;

FIG. 4 is a side view of the movement control screed of FIG. 3 installed proximate a wall transition defined between non-masonry and masonry portions of a building wall in accordance with one embodiment of the present invention; and FIG. 5 depicts a side view of the movement control screed for illustrating a few selected dimensions taken from two exemplary movement control screeds that are structured according to the present invention.

DETAILED DESCRIPTION OF THE INVENTION

The present invention will now be described more fully hereinafter with reference to the accompanying drawings, in which some, but not all embodiments of the inventions are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

For purposes of the foregoing specification and appended claims the term "masonry coating" refers to a surface covering for walls comprised of plaster, stucco, Portland cement, or other similar materials that are applied wet and then dry into a protective and/or aesthetically pleasing surface.

FIG. 3 depicts a perspective view of a movement control screed 120 in accordance with one embodiment of the present invention. The movement control screed 120 comprises a first flange 132, a first rib 122, a second rib 126, and a second flange 134. The movement control screed defines a length L and a width W. In the depicted embodiment, the width W appears larger than the length L; however, in practice, the width W of the movement control screed 120 is likely smaller than the length L. The length L of a movement control screed may, for example, correspond generally to the length of an adjacent building wall while the width W of the movement control screed need only be sufficient to cover small areas of the wall above and below a wall transition. For example, in one embodiment, the length L of a movement control screed is approximately ten feet while the width W is approximately six inches. In various embodiments, the length L of the movement control screed need not correspond directly to the length of an adjacent wall as multiple movement control screeds may be placed side-by-side to span the length of the wall. Caulking can be applied between adjoining screeds to assure proper water handling.

In the depicted embodiment, the first flange 132 of the movement control screed 120 is a substantially planar member that is arranged vertically against a building wall (not shown). The first flange 132 includes an attachment portion 133 and a substantially non-perforated portion 131. The depicted attachment portion 133 defines an aperture 136 for receiving an attaching fastener (not shown) or keying the position of the movement control screed 120 relative to an adjacent movement control screed (not shown) as will be apparent to one of ordinary skill in the art. One or more apertures 136 may be created within the attachment portion 133 during installation of the movement control screed 120 as one or more nails, screws, or other fasteners are used to secure the first flange to the building wall. The substantially non-perforated portion 131 of the first flange 132 operates as a moisture barrier as will be discussed in greater detail below.

The first rib 122 extends from the base of the first flange 132 as shown. In one embodiment, the first rib 122 comprises an extending member 121, a transition member R1, and a returning member 123. The extending member 121 defines a screed or engagement surface 121E that is structured to at least partially contact and support a masonry coating (not shown) when the masonry coating is applied. The first rib 122 can act as a screed to guide the application of the masonry coating when it is wet so that the resultant coating has the desired depth or thickness. After drying, the lower edge of the masonry coating may separate from the engagement surface 121E or the first rib 122 slightly, especially if there is significant contraction of the masonry coating, which can allow water to more readily weep from behind the masonry coating and over the first rib 122.

A drip angle θ is defined between the first flange 132 and the engagement surface 121E of the extending member 121. The drip angle θ is preferably greater than 90 degrees for encouraging moisture to run downwardly along the first flange 132 and on a descending path over the engagement surface 121E and transition member R1 of the first rib 122. In various embodiments, the drip angle θ is between 91 and 145 degrees, preferably between 92 and 120 degrees, and more preferably between 93 and 115 degrees. As will be apparent to one of ordinary skill in the art, providing such drip angles allows water behind the masonry coating to be drawn away from the building wall and to drip harmlessly over the transition member R1 of the first rib 122.

In the depicted embodiment, the second rib 126 is positioned immediately below the first rib 122 and above the second flange 134 as shown. The second rib includes an extending member 125, a transition member R2, and a returning member 127. Although the depicted transitions members R1, R2 define radii between the extending members 121, 125 and the returning members 123, 127 of the first and second ribs 122, 126 other non-radiused transitions are possible. For example, a chamfered, cornered, or pointed transition may be used especially in movement control screeds formed from polymeric materials.

A rib transition 128 is defined between the first rib 122 and the second rib 126. In the depicted embodiment, the rib transition 128 is a simply defined radius however, in additional embodiments, the rib transition 128 may include one or more flat or planar portions (not shown) for expanding a channel 150 defined between the first and second ribs 122, 126.

In various embodiments of the present invention, the returning portion 127 of the second rib defines an engagement surface 127E that is structured to at least partially contact and support a masonry coating (not shown). In the depicted embodiment, one or more anchor tabs 130 extend from the engagement surface 127E for further anchoring an adjacent masonry coating.

The depicted second flange 134 extends from the base of the returning portion 127 of the second rib 126 as shown. In one embodiment, the second flange 134 is at least partially perforated by apertures 138, 139. One or more of the apertures 139 may be structured to receive fasteners (not shown) for securing the second flange 134 to the wall. Other apertures 138 may be provided simply to define a non-continuous surface that is better adapted to support adhesion with an adjacent masonry coating. In other embodiments, various additional known techniques (e.g., etching, roughing, etc.) may be used to encourage adhesion between the second flange 134 and an adjacent masonry coating.

In various embodiments of the present invention, the first rib 122 defines a first screed depth A and the second rib 126 defines a second screed depth B. In the depicted embodiment, the first screed depth A is larger than the second screed depth B. In this regard, moisture running along the engagement surface 121E and over the transition portion R1 of the first rib 122 may be allowed to drip freely from the first rib 122 without impacting the second rib 126. Providing first and second ribs 122, 126 of differing screed depths may also provide additional benefits with regard to the application of masonry coatings having differing thicknesses as will be described in greater detail below.

Movement control screeds of various embodiments of the present invention may be manufactured from a variety of materials. For example, all or part of a movement control screed may be produced from metals such as aluminum, zinc, stainless steel, and galvanized steel, molded or extruded polymers and plastics, composites, and other similar materials. Factors influencing material selection are cost, corrosion resistance, regional or geographic environmental factors (e.g., expected humidity, environmental salinity, temperature, etc.), ease of forming, rigidity, and elasticity. The movement control screed depicted in FIG. 3 is manufactured from a polyvinyl chloride ("PVC" ) resin and, thus, provides a deflectable, rigid, low cost, corrosion resistant, masonry coating-supporting article.

FIG. 4 depicts a side section view of a building wall 205 incorporating a movement control screed 220 in accordance with one embodiment of the present invention. This view has been shown with exaggerated clearances between the various components for clarity and ease of understanding. As noted above, it has become common in many areas of the country to construct homes or other dwellings having first floor exterior walls comprised of reinforced concrete or other similar materials and upper floors or roof structures constructed of wood framing. The depicted building wall 205 includes a masonry portion 210 and a non-masonry portion 211. The non-masonry portion 211 is comprised of framing members 214 including for example, wooden studs, cross-members, and the like, and a plywood sheathing portion 216. A wall transition 215 is defined between the masonry and non-masonry 210, 211 portions of the building wall 205 as shown.

Movement control screeds 220 structured in accordance with various embodiments of the present invention may be installed adjacent a building wall 205 proximate the wall transition 215 defined between the masonry and non-masonry portions 210, 211. In the depicted embodiment, the movement control screed 220 comprises a first flange 232, a first rib 222, a second rib 226, and a second flange 234. The depicted first and second flanges 232, 234 are planar members positioned substantially flush against the non-masonry 211 and masonry 210 portions of the building wall 205, respectively. More particularly, the first flange 232 is secured to the plywood sheathing 216 of the non-masonry portion 211 of the building wall 205 by fasteners 260 such as nails, screws and the like. In one embodiment, the fasteners 260 are disposed generally through an attachment portion 233 of the first flange 232 thereby defining a substantially non-perforated portion 231 below the attachment portion 233 as shown.

One or more layers of water resistant building paper 212 may be provided over the building wall 205, the attachment portion 233 of the first flange 232, and at least a part of the substantially non-perforated portion 231 of the first flange 232 such that any water or moisture running down the building wall 205 drains over and not behind the first flange 232 of the movement control screed 220. In various embodiments, the movement control screed 220 is mounted such that at least part of the substantially non-perforated portion 231 of the first flange 232 extends a transition distance T below the wall transition 215 defined between the masonry and non-masonry portions 210, 211 of the building wall 205. In this regard, the non-perforated portion 231 of the first flange 232 provides a barrier that prevents moisture from entering the wall transition 215 and decaying or otherwise degrading the building wall 205.

The embodiment depicted in FIG. 4 includes a first rib 222 defining a screed depth that is substantially larger than a screed depth defined by the second rib 226. As noted above, the first rib 222 extends from the base of the first flange 232 and includes an extending member 221, a transition member R1, and a returning member 223. The extending member 221 defines a screed or engagement surface 221E that is structured to at least partially contact and support a first masonry coating 245. A drip angle θ is defined between the first flange 232 and the engagement surface 221 E of the extending member 221 as shown. As referenced above, the drip angle θ is preferably greater than 90 degrees for encouraging moisture to run downwardly along the first flange 232 and to continue on a descending path over the engagement surface 221E and transition member R1 of the first rib 222. In this regard, moisture is drawn away from the wall and allowed to drip from the transition member R1 of the first rib 222.

A first masonry coating 245 is applied to the building wall 205 above the movement control screed 220. In one embodiment, a metal or plastic lath 213 may be applied over the relatively smooth surfaces of the building paper 212 and first flange 232 to support the first masonry coating 245. A second masonry coating 255 is applied to the building wall 205 below the movement control screed 220 as shown, and this coating may or may not be applied over lath (not shown) depending on the application. The second rib 226 includes an extending portion 225, a transition member R2, and a returning portion 227. The returning portion 227 of the second rib 226 includes a screed or engagement surface 227E that is structured to contact and support at least part of the second masonry coating 255 as shown. In the depicted embodiment, an anchor tab 230 extends from the engagement surface 227E of the returning portion 227 for anchoring the second masonry coating 255.

In various embodiments of the present invention, the screed depth of the first rib 222 operates as a guide or screed to define a thickness C for the first masonry coating 245. The screed depth of the second rib 226 operates as a guide for defining a thickness D for the second masonry coating 255. In one embodiment, for example, the first and second masonry coatings may be applied at thicknesses sufficient to define first and second outer masonry surfaces that align generally with the outermost points of the transitions members R1, R2 of the first and second ribs 222, 226 as shown. In other embodiments, the masonry coating may be applied at thicknesses sufficient to define first and second outer masonry surfaces that align generally with guide features defined by or disposed on the first and second ribs (not shown). Such guide features may include reference marks, protuberances, ribs, indentions, bends, or any other visible feature. Accordingly, the "screed depths" referred to in the present application and appending claims would be defined between the first and second flanges and such guide features rather than the first and second flanges and the outermost points of the first and second transition members as shown in FIGS. 3 and 5.

Conventional building codes allow masonry coatings applied adjacent walls of differing composition (e.g., wood reinforced portions vs. concrete reinforced portions) to have differing acceptable thicknesses. For example, the requisite coating thickness for masonry coatings applied to a reinforced cement wall or wall portion is less than the masonry coating thickness required for masonry coatings applied to wood framed walls or wall portions. Accordingly, in the depicted embodiment, the movement control screed 220 is structured to define a first masonry coating thickness C adjacent the non-masonry portion 211 of the building wall 205 that is greater than the second masonry coating thickness D defined adjacent the masonry portion 210 of the building wall 205.

As will be apparent to one of ordinary skill in the art, masonry coatings such as stucco or plaster have a measurable coefficient of thermal expansion. If such coatings are applied and rigidly confined, the resulting stresses may produce unsightly cracking. In addition, other factors might cause relative movement between the two sections of masonry coating, such as settling of the building or wind or temperature induced movements between dissimilar (e.g., cement reinforced vs. wood framed, etc.) wall portions. Accordingly, the first flange 232 of the movement control screed 220 may be deflectable from the second flange 234. The screed or engagement surface 221E of the first rib 222 may also be deflectable relative to the screed or engagement surface 227E of the second rib 226. Additionally, the engagement surface 221E of the first rib 222 may be deflectable relative to the first flange 232 and the engagement surface 227E of the second rib 226 may be deflectable from the second flange 234. The above deflections relieve slight relative movement (whether in the plane at the wall or otherwise) and the resulting masonry coating stresses occurring adjacent the wall transition 215.

Example Embodiments

FIG. 5 depicts a side view of a movement control screed for illustrating a few selected dimensions taken from several exemplary movement control screeds. Numerical values for the selected dimensions are provided in Table 1 below for illustration purposely only. The precise dimensions of movement control screeds according to various embodiments of the present invention may vary from application to application as will be apparent to one of ordinary skill in the art. Thus, although numerous examples are provided in Table 1 below, multiple additional embodiments of the present invention may include dimensions and numerical values that are not listed in Table 1. The dimensions selected for Table 1 include an exemplary movement control screed width W, a first rib position X, a second rib position Z, and a channel width Y. Exemplary values for a first screed depth A and a second screed depth B are also provided. Notably, the exemplary values for A and B may be reversed to satisfy embodiments in which it is preferred for the second screed depth B to be larger than the first screed depth A. A transition height T is also defined between the wall transition 315 and the rib transition as shown. The dimensions provided in Table 1 are in inches.

TABLE 1

| | A | B | H | T | X | Y | Z |
|---|---|---|---|---|---|---|---|
| Example 1 | 7/8 | 1/2 | 5 13/16 | 1 | 3 1/2 | 9/16 | 1 3/4 |
| Example 2 | 7/8 | 5/8 | 5 13/16 | 1 | 3 1/2 | 9/16 | 1 3/4 |
| Example 3 | 1/2 | 1/4 | 5 13/16 | 1 | 3 1/2 | 9/16 | 1 3/4 |
| Example 4 | 1/2 | 3/8 | 5 13/16 | 1 | 3 1/2 | 9/16 | 1 3/4 |
| Example 5 | 5/8 | 1/4 | 5 13/16 | 1 | 3 1/2 | 9/16 | 1 3/4 |
| Example 6 | 5/8 | 3/8 | 5 13/16 | 1 | 3 1/2 | 9/16 | 1 3/4 |
| Example 7 | 5/8 | 1/2 | 5 13/16 | 1 | 3 1/2 | 9/16 | 1 3/4 |
| Example 8 | 3/4 | 1/4 | 5 13/16 | 1 | 3 1/2 | 9/16 | 1 3/4 |
| Example 9 | 3/4 | 3/8 | 5 13/16 | 1 | 3 1/2 | 9/16 | 1 3/4 |
| Example 10 | 3/4 | 1/2 | 5 13/16 | 1 | 3 1/2 | 9/16 | 1 3/4 |
| Example 11 | 3/4 | 5/8 | 5 13/16 | 1 | 3 1/2 | 9/16 | 1 3/4 |
| Example 12 | 7/8 | 1/4 | 5 13/16 | 1 | 3 1/2 | 9/16 | 1 3/4 |
| Example 13 | 7/8 | 3/8 | 5 13/16 | 1 | 3 1/2 | 9/16 | 1 3/4 |
| Example 14 | 7/8 | 3/4 | 5 13/16 | 1 | 3 1/2 | 9/16 | 1 3/4 |
| Example 15 | 1 | 1/4 | 5 13/16 | 1 | 3 1/2 | 9/16 | 1 3/4 |
| Example 16 | 1 | 3/8 | 5 13/16 | 1 | 3 1/2 | 9/16 | 1 3/4 |
| Example 17 | 1 | 1/2 | 5 13/16 | 1 | 3 1/2 | 9/16 | 1 3/4 |
| Example 18 | 1 | 5/8 | 5 13/16 | 1 | 3 1/2 | 9/16 | 1 3/4 |
| Example 19 | 1 | 3/4 | 5 13/16 | 1 | 3 1/2 | 9/16 | 1 3/4 |
| Example 20 | 1 | 7/8 | 5 13/16 | 1 | 3 1/2 | 9/16 | 1 3/4 |
| Example 21 | 9/8 | 1/4 | 5 13/16 | 1 | 3 1/2 | 9/16 | 1 3/4 |
| Example 22 | 9/8 | 3/8 | 5 13/16 | 1 | 3 1/2 | 9/16 | 1 3/4 |
| Example 23 | 9/8 | 1/2 | 5 13/16 | 1 | 3 1/2 | 9/16 | 1 3/4 |
| Example 24 | 9/8 | 5/8 | 5 13/16 | 1 | 3 1/2 | 9/16 | 1 3/4 |
| Example 25 | 9/8 | 3/4 | 5 13/16 | 1 | 3 1/2 | 9/16 | 1 3/4 |
| Example 26 | 9/8 | 7/8 | 5 13/16 | 1 | 3 1/2 | 9/16 | 1 3/4 |
| Example 27 | 9/8 | 1 | 5 13/16 | 1 | 3 1/2 | 9/16 | 1 3/4 |
| Example 28 | 1 1/4 | 1/4 | 5 13/16 | 1 | 3 1/2 | 9/16 | 1 3/4 |
| Example 29 | 1 1/4 | 3/8 | 5 13/16 | 1 | 3 1/2 | 9/16 | 1 3/4 |
| Example 30 | 1 1/4 | 1/2 | 5 13/16 | 1 | 3 1/2 | 9/16 | 1 3/4 |
| Example 31 | 1 1/4 | 5/8 | 5 13/16 | 1 | 3 1/2 | 9/16 | 1 3/4 |
| Example 32 | 1 1/4 | 3/4 | 5 13/16 | 1 | 3 1/2 | 9/16 | 1 3/4 |
| Example 33 | 1 1/4 | 7/8 | 5 13/16 | 1 | 3 1/2 | 9/16 | 1 3/4 |
| Example 34 | 1 1/4 | 1 | 5 13/16 | 1 | 3 1/2 | 9/16 | 1 3/4 |
| Example 35 | 1 1/4 | 9/8 | 5 13/16 | 1 | 3 1/2 | 9/16 | 1 3/4 |
| Example 36 | 1 3/8 | 1/4 | 5 13/16 | 1 | 3 1/2 | 9/16 | 1 3/4 |
| Example 37 | 1 3/8 | 3/8 | 5 13/16 | 1 | 3 1/2 | 9/16 | 1 3/4 |
| Example 38 | 1 3/8 | 1/2 | 5 13/16 | 1 | 3 1/2 | 9/16 | 1 3/4 |
| Example 39 | 1 3/8 | 5/8 | 5 13/16 | 1 | 3 1/2 | 9/16 | 1 3/4 |
| Example 40 | 1 3/8 | 3/4 | 5 13/16 | 1 | 3 1/2 | 9/16 | 1 3/4 |
| Example 41 | 1 3/8 | 7/8 | 5 13/16 | 1 | 3 1/2 | 9/16 | 1 3/4 |
| Example 42 | 1 3/8 | 1 | 5 13/16 | 1 | 3 1/2 | 9/16 | 1 3/4 |
| Example 43 | 1 3/8 | 9/8 | 5 13/16 | 1 | 3 1/2 | 9/16 | 1 3/4 |
| Example 44 | 1 3/8 | 1 1/4 | 5 13/16 | 1 | 3 1/2 | 9/16 | 1 3/4 |
| Example 45 | 1 1/2 | 1/4 | 5 13/16 | 1 | 3 1/2 | 9/16 | 1 3/4 |
| Example 46 | 1 1/2 | 3/8 | 5 13/16 | 1 | 3 1/2 | 9/16 | 1 3/4 |
| Example 47 | 1 1/2 | 1/2 | 5 13/16 | 1 | 3 1/2 | 9/16 | 1 3/4 |
| Example 48 | 1 1/2 | 5/8 | 5 13/16 | 1 | 3 1/2 | 9/16 | 1 3/4 |
| Example 49 | 1 1/2 | 3/4 | 5 13/16 | 1 | 3 1/2 | 9/16 | 1 3/4 |
| Example 50 | 1 1/2 | 7/8 | 5 13/16 | 1 | 3 1/2 | 9/16 | 1 3/4 |
| Example 51 | 1 1/2 | 1 | 5 13/16 | 1 | 3 1/2 | 9/16 | 1 3/4 |
| Example 52 | 1 1/2 | 9/8 | 5 13/16 | 1 | 3 1/2 | 9/16 | 1 3/4 |
| Example 53 | 1 1/2 | 1 1/4 | 5 13/16 | 1 | 3 1/2 | 9/16 | 1 3/4 |
| Example 54 | 1 1/2 | 1 3/8 | 5 13/16 | 1 | 3 1/2 | 9/16 | 1 3/4 |
| Example 55 | 1 5/8 | 1/4 | 5 13/16 | 1 | 3 1/2 | 9/16 | 1 3/4 |
| Example 56 | 1 5/8 | 3/8 | 5 13/16 | 1 | 3 1/2 | 9/16 | 1 3/4 |
| Example 57 | 1 5/8 | 1/2 | 5 13/16 | 1 | 3 1/2 | 9/16 | 1 3/4 |
| Example 58 | 1 5/8 | 5/8 | 5 13/16 | 1 | 3 1/2 | 9/16 | 1 3/4 |

TABLE 1-continued

| | A | B | H | T | X | Y | Z |
|---|---|---|---|---|---|---|---|
| Example 59 | 1⅝ | ¾ | 5 13/16 | 1 | 3½ | 9/16 | 1¾ |
| Example 60 | 1⅝ | ⅞ | 5 13/16 | 1 | 3½ | 9/16 | 1¾ |
| Example 61 | 1⅝ | 1 | 5 13/16 | 1 | 3½ | 9/16 | 1¾ |
| Example 62 | 1⅝ | ⅝ | 5 13/16 | 1 | 3½ | 9/16 | 1¾ |
| Example 63 | 1⅝ | 1¼ | 5 13/16 | 1 | 3½ | 9/16 | 1¾ |
| Example 64 | 1⅝ | 1⅜ | 5 13/16 | 1 | 3½ | 9/16 | 1¾ |
| Example 65 | 1⅝ | 1½ | 5 13/16 | 1 | 3½ | 9/16 | 1¾ |
| Example 66 | 1¾ | ¼ | 5 13/16 | 1 | 3½ | 9/16 | 1¾ |
| Example 67 | 1¾ | ⅜ | 5 13/16 | 1 | 3½ | 9/16 | 1¾ |
| Example 68 | 1¾ | ½ | 5 13/16 | 1 | 3½ | 9/16 | 1¾ |
| Example 69 | 1¾ | ⅝ | 5 13/16 | 1 | 3½ | 9/16 | 1¾ |
| Example 70 | 1¾ | ¾ | 5 13/16 | 1 | 3½ | 9/16 | 1¾ |
| Example 71 | 1¾ | ⅞ | 5 13/16 | 1 | 3½ | 9/16 | 1¾ |
| Example 72 | 1¾ | 1 | 5 13/16 | 1 | 3½ | 9/16 | 1¾ |
| Example 73 | 1¾ | ⅝ | 5 13/16 | 1 | 3½ | 9/16 | 1¾ |
| Example 74 | 1¾ | 1¼ | 5 13/16 | 1 | 3½ | 9/16 | 1¾ |
| Example 75 | 1¾ | 1⅜ | 5 13/16 | 1 | 3½ | 9/16 | 1¾ |
| Example 76 | 1¾ | 1½ | 5 13/16 | 1 | 3½ | 9/16 | 1¾ |
| Example 77 | 1¾ | 1⅝ | 5 13/16 | 1 | 3½ | 9/16 | 1¾ |
| Example 78 | 1⅞ | ¼ | 5 13/16 | 1 | 3½ | 9/16 | 1¾ |
| Example 79 | 1⅞ | ⅜ | 5 13/16 | 1 | 3½ | 9/16 | 1¾ |
| Example 80 | 1⅞ | ½ | 5 13/16 | 1 | 3½ | 9/16 | 1¾ |
| Example 81 | 1⅞ | ⅝ | 5 13/16 | 1 | 3½ | 9/16 | 1¾ |
| Example 82 | 1⅞ | ¾ | 5 13/16 | 1 | 3½ | 9/16 | 1¾ |
| Example 83 | 1⅞ | ⅞ | 5 13/16 | 1 | 3½ | 9/16 | 1¾ |
| Example 84 | 1⅞ | 1 | 5 13/16 | 1 | 3½ | 9/16 | 1¾ |
| Example 85 | 1⅞ | ⅝ | 5 13/16 | 1 | 3½ | 9/16 | 1¾ |
| Example 86 | 1⅞ | 1¼ | 5 13/16 | 1 | 3½ | 9/16 | 1¾ |
| Example 87 | 1⅞ | 1⅜ | 5 13/16 | 1 | 3½ | 9/16 | 1¾ |
| Example 88 | 1⅞ | 1½ | 5 13/16 | 1 | 3½ | 9/16 | 1¾ |
| Example 89 | 1⅞ | 1⅝ | 5 13/16 | 1 | 3½ | 9/16 | 1¾ |
| Example 90 | 1⅞ | 1¾ | 5 13/16 | 1 | 3½ | 9/16 | 1¾ |
| Example 91 | 2 | ¼ | 5 13/16 | 1 | 3½ | 9/16 | 1¾ |
| Example 92 | 2 | ⅜ | 5 13/16 | 1 | 3½ | 9/16 | 1¾ |
| Example 93 | 2 | ½ | 5 13/16 | 1 | 3½ | 9/16 | 1¾ |
| Example 94 | 2 | ⅝ | 5 13/16 | 1 | 3½ | 9/16 | 1¾ |
| Example 95 | 2 | ¾ | 5 13/16 | 1 | 3½ | 9/16 | 1¾ |
| Example 96 | 2 | ⅞ | 5 13/16 | 1 | 3½ | 9/16 | 1¾ |
| Example 97 | 2 | 1 | 5 13/16 | 1 | 3½ | 9/16 | 1¾ |
| Example 98 | 2 | ⅝ | 5 13/16 | 1 | 3½ | 9/16 | 1¾ |
| Example 99 | 2 | 1¼ | 5 13/16 | 1 | 3½ | 9/16 | 1¾ |
| Example 100 | 2 | 1⅜ | 5 13/16 | 1 | 3½ | 9/16 | 1¾ |
| Example 101 | 2 | 1½ | 5 13/16 | 1 | 3½ | 9/16 | 1¾ |
| Example 102 | 2 | 1⅝ | 5 13/16 | 1 | 3½ | 9/16 | 1¾ |
| Example 103 | 2 | 1¾ | 5 13/16 | 1 | 3½ | 9/16 | 1¾ |
| Example 104 | 2 | 1⅞ | 5 13/16 | 1 | 3½ | 9/16 | 1¾ |

Many modifications and other embodiments of the invention set forth herein will come to mind to one skilled in the art to which these inventions pertain having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A movement control screed structured for installation between first and second masonry coatings applied adjacent a building wall, wherein the first and second masonry coatings are subject to movement relative to each other, the movement control screed comprising: a first flange defining a substantially non-perforated surface; a second flange defining a substantially perforated surface; a first rib disposed between the first and second flanges, the first rib defining a screed surface positioned adjacent at least a portion of the first masonry coating when the first masonry coating is applied, wherein the substantially non-perforated surface of the first flange and the screed surface of the first rib combine to define a moisture path adapted to direct water from behind the first masonry coating and away from the building wall; and a second rib disposed between the first and second flanges, the second rib defining a screed surface positioned adjacent at least a portion of the second masonry coating when the second masonry coating is applied, wherein the movement control screed is structured such that the first flange is deflectable relative to the second flange for supporting the first and second masonry coatings during relative movement; and wherein the first rib defines a first screed depth corresponding to a first masonry coating thickness and the second rib defines a second screed depth that is smaller than the first screed depth and corresponds to a second masonry coating thickness.

2. The movement control screed of claim 1, wherein the first screed depth ranges between 0.5 and 2 inches and the second screed depth ranges between 0.25 and 1.875 inches.

3. A movement control screed structured for installation between first and second masonry coatings applied adjacent a building wall, comprising: a first flange defining a substantially non-perforated surface structured for positioning adjacent a first portion of the building wall; a second flange defining a substantially perforated surface structured for positioning adjacent a second portion of the building wall; a first rib disposed between the first and second flanges, the first rib defining a first screed depth that corresponds to a first masonry coating thickness, wherein the substantially non-perforated surface of the first flange combines with the first rib to define a moisture path adapted to direct water away from the building wall; and a second rib disposed between the first and second flanges, the second rib defining a second screed depth that corresponds to a second masonry coating thickness, wherein the first screed depth differs from the second screed depth; and wherein the first screed depth is larger than the second screed depth.

4. The movement control screed of claim 3, wherein the first screed depth ranges between 0.5 and 2 inches and the second screed depth ranges between 0.25 and 1.875 inches.

* * * * *